United States Patent [19]

Willis

[11] 4,032,138

[45] June 28, 1977

[54] ADJUSTABLE POSITION COUNTERWEIGHT ASSEMBLY FOR AMUSEMENT RIDE

[75] Inventor: David Barry Willis, Palo Alto, Calif.

[73] Assignee: Arrow Development Co., Inc., Mountain View, Calif.

[22] Filed: June 28, 1976

[21] Appl. No.: 700,397

[52] U.S. Cl. ..... 272/33 R; 214/142; 248/364; 272/38

[51] Int. Cl.[2] ..... A63G 1/12

[58] Field of Search ..... 272/33 R, 38, 49, 55, 272/54, 31 A, 31 B, 88, 89; 214/142; 16/1 C, DIG. 8; 248/331, 364; 173/49; 74/61

[56] References Cited

UNITED STATES PATENTS

| | | | |
|---|---|---|---|
| 2,076,113 | 4/1937 | Bartlett | 272/33 R |
| 2,184,200 | 12/1939 | Thomas | 74/41 |
| 2,537,399 | 1/1951 | Doris | 272/33 R |
| 2,584,921 | 2/1952 | Rawnsley et al. | 248/364 X |
| 3,298,685 | 1/1967 | Williams | 272/33 R |
| 3,679,078 | 7/1972 | Wetzel | 214/142 |
| 3,972,527 | 8/1976 | Bacon | 272/33 R |

*Primary Examiner*—Harland S. Skogouist
*Assistant Examiner*—Arnold W. Kramer
*Attorney, Agent, or Firm*—Limbach, Limbach & Sutton

[57] ABSTRACT

In a passenger propelled swinging ride assembly, a variable counterweight employing two eccentrically weighted wheels driven in opposite directions to effect a variable counterweight.

8 Claims, 6 Drawing Figures

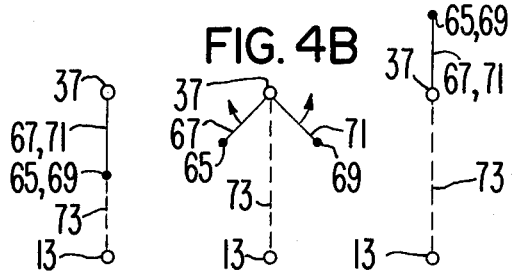
FIG. 4A FIG. 4B FIG. 4C
FIG. 2
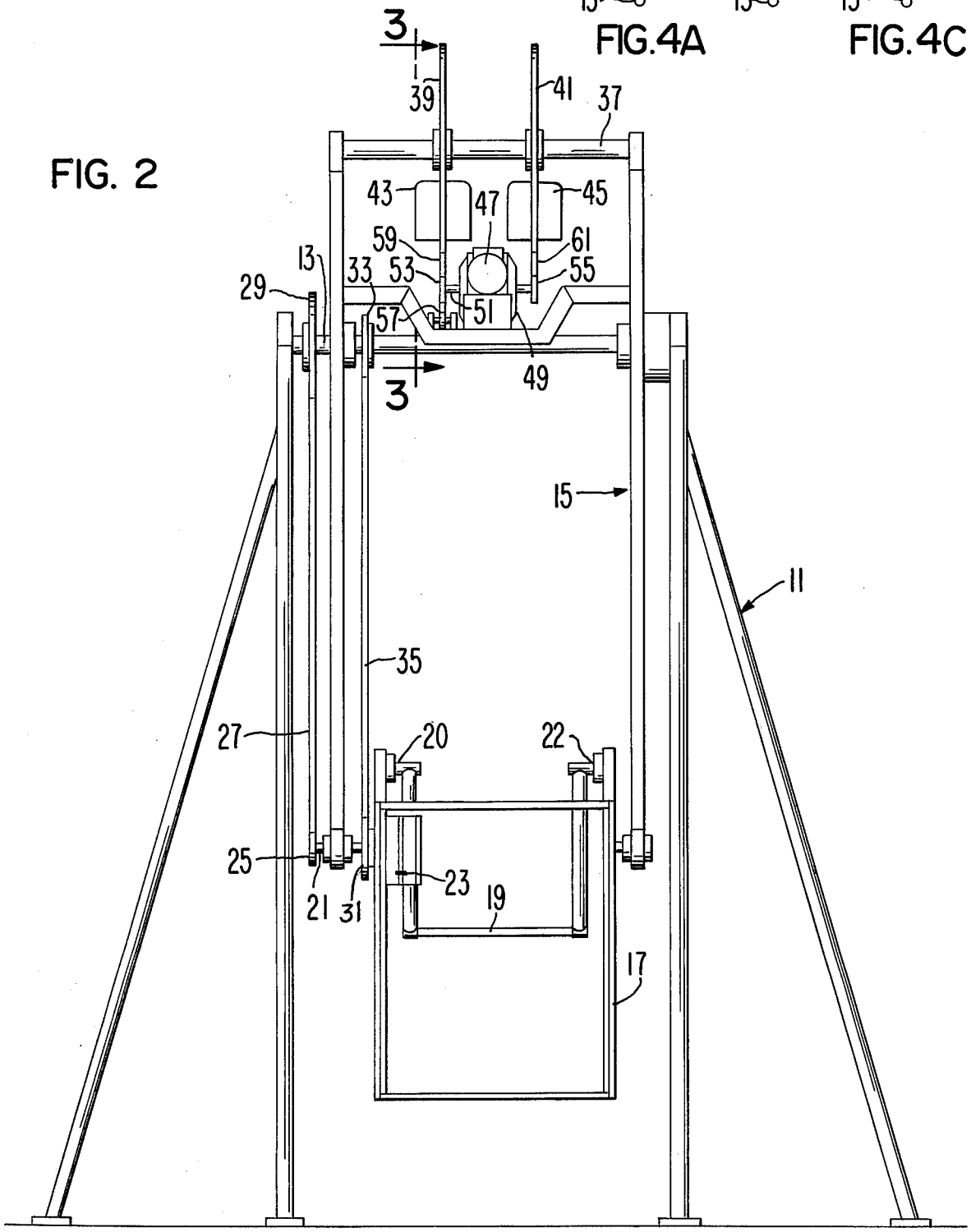

ADJUSTABLE POSITION COUNTERWEIGHT ASSEMBLY FOR AMUSEMENT RIDE

BACKGROUND OF THE INVENTION

This invention relates generally to an adjustable counterweight mechanism useful in compensating for varying loads, and more particularly to such a variable counterweight assembly particularly adapted for compensating for varying passenger weight that may be carried by a passenger powered swinging amusement ride.

Such an amusement ride is disclosed in co-pending patent application Ser. No. 623,146 by Karl W. Bacon, filed Oct. 16, 1975, now U.S. Pat. No. 3,972,527, issued Aug. 3, 1976 and having the same assignee as the present application. In that application, an amusement ride is illustrated that includes a passenger carrying cage that can hold from one passenger up to 4 passengers. This cage is pivotally held at one end of a support structure that is itself pivotally mounted, at a position intermediate of its ends, to a fixed support assembly. The opposite end of the support arm carries a counterweight. The support arm is permitted to rotate in a full circle about its pivotable attachment to the fixed support frame. Such rotation is accomplished by the passengers themselves by movement back and forth of a lever provided within the passenger cage. Since the passenger cage may carry at one time a light weight child and another time four heavy adults, the amount of effort necessary to make the ride swing will vary considerably. Therefore, a variable position counterweight is desirable to compensate for this varying passenger load.

Accordingly, it is a primary object of the present invention to provide an improved adjustable position counterweight assembly for such an amusement ride.

It is another object of the present invention to provide a variable counterweight assembly useful in any application where a varying swinging or balancing load is encountered, including other amusement ride applications.

SUMMARY OF THE INVENTION

These and additional objects are accomplished by the present invention wherein, briefly, the adjustable counterweight mechanism includes two eccentrically weighted wheels mounted on said support arm to pivot about an axis that is substantially parallel to the axis of rotation of the support arm about the fixed support frame. Means are provided on the support arm for rotating these wheels in opposite directions, wherein the effective counterweight is the same as if a single weight is adjusted back and forth within the plane of the support arm. Although the mechanism of the present invention was uniquely designed to satisfy a need of the passenger powered swinging ride assembly previously described, it will be recognized that the invention has application to numerous types of structures wherein a variable position counterweight is required.

Additional objects, advantages and features of the present invention will become apparent from the following description of its preferred embodiment which should be taken in conjunction with the accompanying drawings.

BRIEF DESCRIPTION OF THE DRAWINGS

FIG. 2 is a front view of the ride of FIG. 1;

FIGS. 4A, 4B and 4C are schematic diagrams which illustrate the relative weight movement of the counterweight assembly illustrated in FIGS. 1 through 3, as viewed from the position of section 3—3 of FIG. 2.

DESCRIPTION OF A PREFERRED EMBODIMENT

Figure 1:
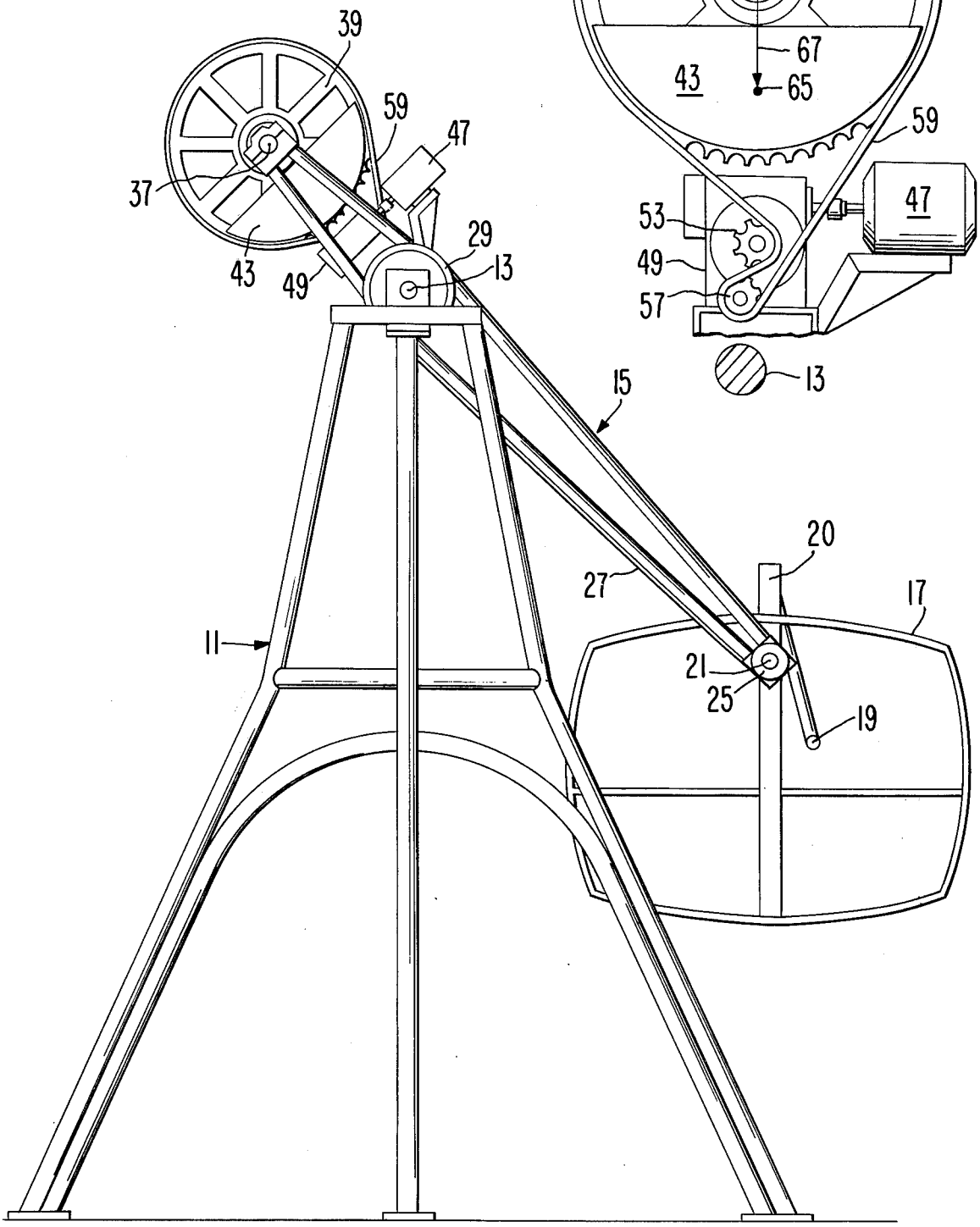
FIG. 1 is a side view of an amusement ride that includes an adjustable position counterweight of the present invention.

Referring initially to FIGS. 1 and 2, the over all passenger powered swinging amusement ride will be described in which the improved adjustable position counterweight of the present invention is utilized. This ride is the same in concept as that described and claimed in aforementioned U.S. Pat. No. 3,972,527 except that certain modifications in specific structure have been made. A fixed support frame 11 has a horizontal support bar 13 held at its top. A support arm 15 is pivotally held about said fixed horizontal rod 13 in a manner that the support arm 15 may be swung in a full circle thereabout.

Pivotally connected to one end of the support arm 15 is a passenger cage 17 capable of holding up to four passengers in a standing or partially sitting position. A horizontal bar 19 is provided in the middle of the passenger cage 17 in a manner that two passengers can be accommodated on either side of the bar 19. The bar 19 is fixed to side arms that are pivotably attached at positions 20 and 22 to the top of the passenger cage 17. Passengers cooperatively push the bar back and forth in order to provide movement of the support arm 15 about the horizontal bar 13. Movement of the bar 19 is converted into rotary motion of a support shaft 21 through a scotch yoke mechanism 23 that operably connects the bar 19 and the shaft 21. At an end of the shaft 21 is a sprocket 25 fixedly attached thereto. A chain 27 operably connects this sprocket 25 to a larger sprocket 29 that is in turn fixedly attached to the horizontal bar 13. The rotating rod 21 is journaled at the end of one leg of the support arm 15 and also serves to support one side of the passenger cage 17. Movement of the horizontal bar 19, therefore, causes the rod 21 to rotate and move the entire passenger cage and support arm 15 assembly in a circle about the fixed horizontal rod 13.

In order to maintain the passenger cage 17 horizontal at all rotary positions of the support arm 15, additional sprockets 31, 33 and an interconnecting chain 35 are provided. The sprocket 31 is fixed to the passenger cage 17 and the sprocket 33 is fixedly attached to the horizontal bar 13.

The elongated, rigid and straight support arm 15 extends to the other side of the horizontal bar 13 to terminate in a shaft 37 that is held parallel to the fixed shaft 13 at all positions of the support arm 15. The principal elements of the variable position counterweight assembly are wheels 39 and 41 that contain heavy eccentrically held weights 43 and 45, respectively. The eccentrically weighted wheels 39 and 41 are held in a spaced apart position along the rod 37 in a manner to be freely and independently rotatable thereabout. The rotatable position of these wheels determines the amount of effective counterweight to the support arm 15.

Figure 3:
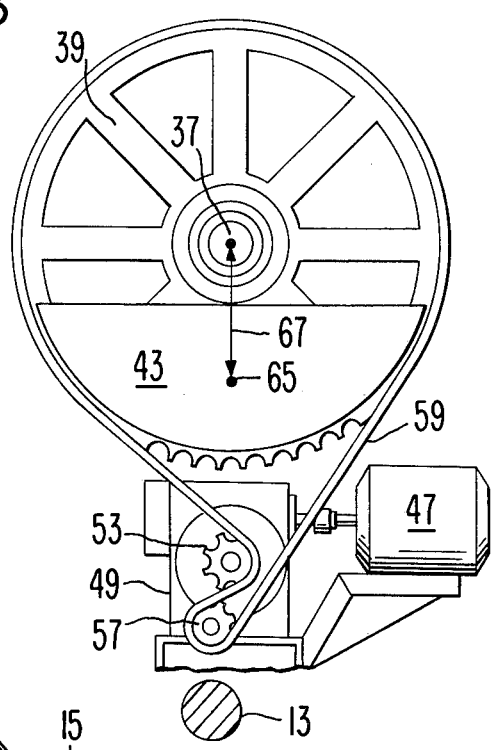
FIG. 3 is a sectional view of the amusement ride of FIGS. 1 and 2, taken across section 3—3 of FIG. 2.

In order to simulate the effect of a single counterweight that is slid back and forth along the support frame 15, as disclosed with reference to FIG. 5 of the aforementioned U.S. Pat. No. 3,972,527, the wheels 39 and 41 are driven in opposite directions by a common, interconnecting motor source. An electric motor 47, controllable by the operator on the ground through an electrical system (not shown), drives a gear box 49 which reduces the speed of the motor at a single driven output shaft 51. Attached at either side of the shaft 51 are sprockets 53 and 55. An idler sprocket 57 is mounted to freely rotate directly below the sprocket 53. In turn, the sprockets 53 and 57 are both mounted directly below the thin wheel 39 which is provided with chain engaging sprocket teeth on its outside surface. The three sprockets (39, 53 and 57) are connected by a single endless chain 59. Similarly, the wheel 41 has an identical toothed outside circumference which engages a chain 61. The chain 61 also engages the sprocket 55 that is located directly below the wheel 41. The chain 59 is constrained by the idler wheel 57 to travel in a path contacting its driving sprocket 53 in a manner to drive it in an opposite direction than the sprocket 55 drives the chain 61. This use of the idler sprocket 57 is best illustrated in FIG. 3. The result is that each of the wheels 39 and 41 are driven at the same speed in opposite directions in response to energization of the motor 47.

Each of the wheels 39 and 41 has an identical structure of a thin but strong spoked metal wheel. The eccentric weights 43 and 45, in this particular embodiment, are bolted onto the respective wheels. It is optimum to keep the weights 43 and 45 concentrated as much as possible, the embodiment illustrated showing the weights to be attached along the circumference of the wheels through an arc of about 145°.

Referring to FIGS. 3 and 4, a conceptual center 65 of mass (centroid) of the wheel 39 with its counterweight 43 attached is illustrated. The operation of the counterweight assembly will be explained with respect to such schematic centers of mass. The center of mass 65 is positioned a radial distance from the axis of rotation of the wheel 39 as indicated by the radial line 67. Similarly, when viewed in the same direction as indicated by the arrows of section 3—3 of FIG. 2, the wheel 41 and concentrated weight 45 can be viewed to have a center of mass 69 a radial distance 71 from the axis of rotation of the wheel 41. The mass 65 is equal to the mass 69 and the radial distance 67 is the same as the radial distance 71. This gives equal but opposite effective counterweight movement upon counter-rotation of the wheels 39 and 41.

Referring to the schematic diagrams of FIGS. 4A, 4B and 4C, three different positions of the wheels 39 and 41 are represented by their schematic centers of mass. A dotted line 73 joins the axis of rotation of the support arm 15 with the axis of rotation of the counterweight wheels 39 and 41. Since these axes are parallel to one another, they form a plane surface and the dotted line 73 indicates an edge of that plane.

FIG. 4A illustrates the position of the wheels 39 and 41 wherein they are the same and their centers of mass 65 and 69 are superimposed. The drive mechanism for the wheels 39 and 41 is set so that the superposition of the centers of mass 65 and 69 occurs at the plane 73 as illustrated in FIG. 4A. Under this condition, a rotation of the wheels 39 and 41 through 180° in opposite directions, as indicated by the arrows of FIG. 4B, results in the centers of mass of the wheels 39 and 41 being superimposed again, as shown in FIG. 4C. Both of these centers of mass 65 and 69 are then again positioned in the plane 73 (FIG. 4C).

It will be noted from FIG. 4B that when the wheels 39 and 41 are rotated to a position intermediate of the superimposed positions of FIGS. 4A and 4C, that the centers of mass 65 and 69 are located on opposite sides of the plane 73 an equal distance therefrom. Therefore, there is no net weight located outside the plane 73 at any rotational position of the wheels 39 and 41. Thus, for any such position, the support arm 15 will generally be vertical when the ride is at rest and passengers can enter and leave from the passenger cage 17 at the same position no matter what the initial position of the wheels 39 and 41. This counterweight system gives the same effect of a weight being slid back and forth in the plane 73.

The factors that go into determining the size of the wheels 39 and 41 and the magnitudes of the weights 43 and 45 for the specific application being described will now be outlined. It is reasonable to assume that in such a swinging ride that the range of weight of the passengers would most often lie between 80 pounds for a child and around 200 pounds for an adult. A single child of 80 pounds, at the minimum end of the scale, could operate the ride by his or herself while at the maximum end of the scale four adults totaling 800 pounds could operate the ride. Thus, it is reasonable to plan for a uniform operation throughout a 500 pound difference. In order to be adjustable for a 500 pound weight difference, the counterweight assembly should have a magnitude of concentrated mass at its centers 65 and 69 that when added together and multiplied by twice the radial distance 67 (same as 71), it is equal to approximately at least the distance from the horizontal bar 13 to the position of the variable passenger weight times the magnitude of that variable weight. In this specific illustration, the magnitude of the variable passenger weight being considered is 500 pounds.

A further advantage of the rotating counterweight assembly described herein is that in the event a chain or other positioning element breaks during operation, the permanently centered counterweight will not impact against another part of a structure. It will be recognized that a sliding counterweight will severly shock the swinging assembly if it breaks loose and is permitted to fall with gravity.

Although the counterweight assembly of the present invention has been described with respect to a particular type of amusement ride application because it particularly satisfies a need in that application, it will be recognized that the counterweight invention has application in other places as well. In other amusement rides, such as a ride wherein only one passenger could be carried at a time, the maximum weight variable to be considered in the above analysis could be only about 100 pounds. And although such a counterweight assembly has a particular advantage in a passenger powered amusement ride in order to keep the amount of passenger effort reasonably constant no matter what the passenger load, it also has an advantage in motor driven rides in maintaining the motive force reasonably constant. And finally, the counterweight assembly of the present invention has application in a large number of other applications wherever a variable position counterweight is desired. Therefore, the present invention is entitled to protection within the full scope of the appended claims.

I claim:

1. In an amusement ride wherein an elongated support arm is pivotably held at an axis intermediate of its ends by a stationary frame, means being attached to the support arm on one side of this axis for carrying one or more passengers and means being attached to the support arm on the other side of the pivot axis for providing a weight to counter that of the passengers and the passenger carrying means, an improved counterweight assembly that is adjustable in position to compensate for varying passenger weight that can be carried by the passenger carrying means, comprising:

a pair of wheels held by said other side of the support arm for independent rotation about a second axis that is parallel to said first axis, each of said wheels being unbalanced in substantially the same manner by having a major portion of its weight concentrated over a small segment of its circular extent, and means interconnecting said wheels for rotating the wheels in opposite directions about said second axis, thereby to control the effective counterweight position relative to said first axis.

2. The improved amusement ride counterweight assembly according to claim 1 wherein the wheel interconnecting means is constructed so that the centers of mass of the wheels lie in a plane formed by said first and second axes at the positions wherein the centers of mass of the two wheels are aligned with one another, whereby concurrent but oppositely directed rotation of said wheels moves the effective counterweight outward or inward in a direction of said plane without any significant component of offset moment.

3. The improved amusement ride counterweight assembly according to claim 1 wherein the magnitude of the unbalanced weight of the two wheels is such relative to the radius to the center of mass of these weights on the wheels so that their product times a factor of two is equal to at least a product of the distance from the first axis to the passenger carrying means times the expected passenger weight variation for which the counterweight assembly is designed to compensate.

4. The improved amusement ride counterweight assembly according to claim 3 wherein the passenger weight variation compensated for is in excess of 100 pounds.

5. The improved amusement ride counterweight assembly according to claim 3 wherein the passenger weight variation compensated for is in excess of 500 pounds.

6. The improved amusement ride counterweight assembly according to claim 1 wherein said wheel rotating means comprises:

a single motor source carried by said support arm and being controllable by an operator of the amusement ride, and means including the use of a continuous flexible drive member associated with each of said wheels for connecting said wheels to said motor source.

7. In a structure wherein an elongated support arm is pivotally held at an axis intermediate of its ends by a stationary frame, means being attached to the support arm on one side of the axis for carrying a varying weight and means being attached to the support arm on the other side of the pivot axis for providing a weight to counter that of the variable carried weight, an improved counterweight assembly that is adjustable to compensate for such potential varying weight carried by the support arm, comprising:

a pair of wheels held by said other side of the support arm for independent rotation about a second axis that is parallel to said first pivot axis, each of said wheels being unbalanced in substantially the same manner by having a major portion of its weight concentrated over a small segment of its circular extent, and means interconnecting said wheels for rotating the wheels in opposite directions about said second axis, thereby to control the effective counterweight position relative to said first pivot axis, wherein the wheel interconnecting means is constructed so that the centers of mass of the two wheels lie in a plane formed by said first and second axes at the positions wherein the centers of mass of the two wheels are aligned with one another, whereby concurrent but oppositely directed rotation of said wheels moves the effective counterweight outward or inward in a direction of said plane without any significant component of offset moment.

8. The improved counterweight assembly according to claim 7 wherein said rotating means additionally comprises means for rotating the wheels at the same speed in opposite directions.

* * * * *